US007909021B2

(12) United States Patent
Fujii

(10) Patent No.: US 7,909,021 B2
(45) Date of Patent: Mar. 22, 2011

(54) FUEL DAMPER FIXING CLIP

(75) Inventor: Takeshi Fujii, Komae (JP)

(73) Assignee: Nissan Motor Co., Ltd., Yokohama-shi, Kanagawa (JP)

( * ) Notice: Subject to any disclaimer, the term of this patent is extended or adjusted under 35 U.S.C. 154(b) by 420 days.

(21) Appl. No.: 12/175,617

(22) Filed: Jul. 18, 2008

(65) Prior Publication Data

US 2009/0044784 A1 Feb. 19, 2009

(30) Foreign Application Priority Data

Aug. 15, 2007 (JP) ..... 2007-211822

(51) Int. Cl.
*F02M 61/14* (2006.01)

(52) U.S. Cl. ..... 123/470; 24/20 EE

(58) Field of Classification Search ..... 123/468, 123/469, 470; 24/20 TT, 20 EE
See application file for complete search history.

(56) References Cited

U.S. PATENT DOCUMENTS

| | | | | | |
|---|---|---|---|---|---|
| 1,441,154 | A | * | 1/1923 | Johnson | 24/20 R |
| 4,483,556 | A | * | 11/1984 | LiVolsi | 285/252 |
| 4,557,024 | A | * | 12/1985 | Roberts et al. | 24/20 TT |
| 5,094,211 | A | | 3/1992 | Mahnke et al. | |
| 5,577,478 | A | | 11/1996 | Tuckey | |
| 5,842,450 | A | | 12/1998 | Fort et al. | |
| 6,539,920 | B1 | * | 4/2003 | Spiers | 123/456 |
| 7,210,462 | B2 | * | 5/2007 | Scheffel et al. | 123/470 |
| D580,748 | S | * | 11/2008 | Polak et al. | D8/394 |
| 7,581,530 | B2 | * | 9/2009 | Scheffel et al. | 123/470 |
| 2004/0134042 | A1 | * | 7/2004 | Craig, Jr. | 24/20 EE |

FOREIGN PATENT DOCUMENTS

| | | | |
|---|---|---|---|
| DE | 201 04 270 U1 | | 8/2002 |
| EP | 0 669 459 A2 | | 8/1995 |
| JP | 2009-47020 | * | 3/2009 |
| WO | WO 99/04161 | | 1/1999 |
| WO | WO 99/61783 | | 12/1999 |

* cited by examiner

*Primary Examiner* — Hai H Huynh
(74) *Attorney, Agent, or Firm* — Drinker Biddle & Reath LLP

(57) ABSTRACT

A fuel damper fixing clip includes a clip main body formed from a sheet member having a plurality of flat portions, and formed in a generally square cylindrical shape. The clip main body surrounds portions of the outer peripheries of a cup portion and a fuel damper and deforms in a tightening direction. The clip main body includes two ends overlapped on an outside and an inside surface thereof. Slits are disposed in the plurality of flat portions of the clip main body, and the collar portions of the cup portion and the fuel damper are disposed therein and locked in a diameter-reduced state of the clip main body in which the clip main body is tightened. A receiving hole is formed in one of the ends of the clip main body. A claw portion is disposed on the other end of the clip main body obliquely projecting in a direction opposite to the tightening direction. The claw portion is disposed in the receiving hole in the diameter-reduced state in which the clip main body is tightened, and locks the clip main body in the diameter-reduced state in which the collar portions are fixed.

13 Claims, 8 Drawing Sheets

FUEL DAMPER FIXING CLIP

This application claims priority under 35 U.S.C. §119 to Japanese Patent Application No. 2007-211822, filed on Aug. 15, 2007, which is incorporated by reference herein in its entirety.

FIELD OF THE INVENTION

The present invention relates generally to a fuel damper fixing clip for fixing a diaphragm type fuel damper to a cup portion which opens in communication with a fuel pipe in an internal combustion engine.

BACKGROUND OF THE INVENTION

A related art clip is formed from a sheet member in a U-shape, as a clip for fixing the base end of a fuel injection valve to a fuel pipe in an internal combustion engine. In this arrangement, after the clip is attached to the fuel injection valve, they are mounted on a fuel pipe together.

However, while the related art clip is used to fix the base end of the fuel injection valve to the fuel pipe, the distal end of the fuel injection valve is fixed to an intake manifold (or cylinder head). Thus, the clip for fixing the fuel injection valve to the fuel pipe is not required to have so much holding force. Accordingly, the clip is formed in the U-shape and arranged so that it can be easily removed.

In contrast, in a clip for fixing a fuel damper to a fuel pipe, the fuel damper is fixed only to the fuel pipe and is not fixed to any other portion. Thus, the clip must securely fix the fuel damper so that it does not fall off.

From the above point of view, since the related art U-shaped clip does not have sufficient holding force, there is a possibility that the clip is loosened (deformed) and falls off when an excessively large force is applied thereto. Thus, the clip cannot be applied to the fuel damper fixing clip.

In view of the above circumstances, an object of the present invention is to provide a fuel damper fixing clip which can easily fix a fuel damper and will not fall off.

SUMMARY OF THE INVENTION

In an embodiment, the invention provides a fuel damper fixing clip for fixing both a collar portion around the outer periphery of an open end of a cup portion and a collar portion around the outer periphery of an intermediate portion of a diaphragm type fuel damper in a state such that a head portion of the fuel damper is engaged in the cup portion. The cup portion is in communication with a fuel pipe for supplying fuel to an internal combustion engine. The collar portion of the cup portion is joined to the collar portion of the fuel damper. The fuel damper fixing clip includes a clip main body formed from a sheet member having a plurality of flat portions, and formed in a generally square cylindrical shape. The clip main body surrounds portions of the outer peripheries of the cup portion and the fuel damper and deforms in a tightening direction. The clip main body includes two ends overlapped on an outside and an inside surface thereof. Slits are disposed in the plurality of flat portions of the clip main body, and the collar portions of the cup portion and the fuel damper are disposed therein and locked in a diameter-reduced state of the clip main body in which the clip main body is tightened. A receiving hole is formed in one of the ends of the clip main body. A claw portion is disposed on the other end of the clip main body obliquely projecting in a direction opposite to the tightening direction. The claw portion is disposed in the receiving hole in the diameter-reduced state in which the clip main body is tightened, and locks the clip main body in the diameter-reduced state in which the collar portions are fixed.

In another embodiment, the invention provides a method of fixing both a collar portion around the outer periphery of an open end of a cup portion and a collar portion around the outer periphery of an intermediate portion of a diaphragm type fuel damper in a state such that a head portion of the fuel damper is engaged in the cup portion and the collar portion of the cup portion is joined to the collar portion of the fuel damper. The cup portion is in communication with a fuel pipe for supplying fuel to an internal combustion engine. The method includes providing a fuel damper fixing clip having a clip main body formed from a sheet member having a plurality of flat portions and formed in a generally square cylindrical shape, slits disposed in the plurality of flat portions of the clip main body, a receiving hole formed in one end of the clip main body, and a claw portion disposed on another end of the clip main body obliquely projecting in a direction opposite to a tightening direction. The method further includes surrounding portions of the outer peripheries of the cup portion and the fuel damper with the clip main body, disposing the collar portions of the cup portion and the fuel damper in the slits, overlapping the two ends of the clip main body on an outside and an inside surface thereof, deforming the clip main body in a tightening direction in a diameter-reduced state, disposing the claw portion in the receiving hole in the diameter-reduced state in which the clip main body is tightened, and locking the clip main body in the diameter-reduced state in which the collar portions are fixed.

According to the present invention, since the clip is wound and tightened from the entire periphery thereof and held by the slits, it can be securely fixed. Further, since the claw portion enters into the receiving hole in a diameter-reduced state in which the clip is wound and tightened and locks the return of the clip, the claw portion can be securely fixed.

BRIEF DESCRIPTION OF THE DRAWINGS

The accompanying drawings, which are incorporated herein and constitute part of this specification, illustrate the presently preferred embodiments of the invention, and together with the general description given above and the detailed description given below, serve to explain features of the invention.

DETAILED DESCRIPTION OF THE PREFERRED EMBODIMENTS

Figure 1:
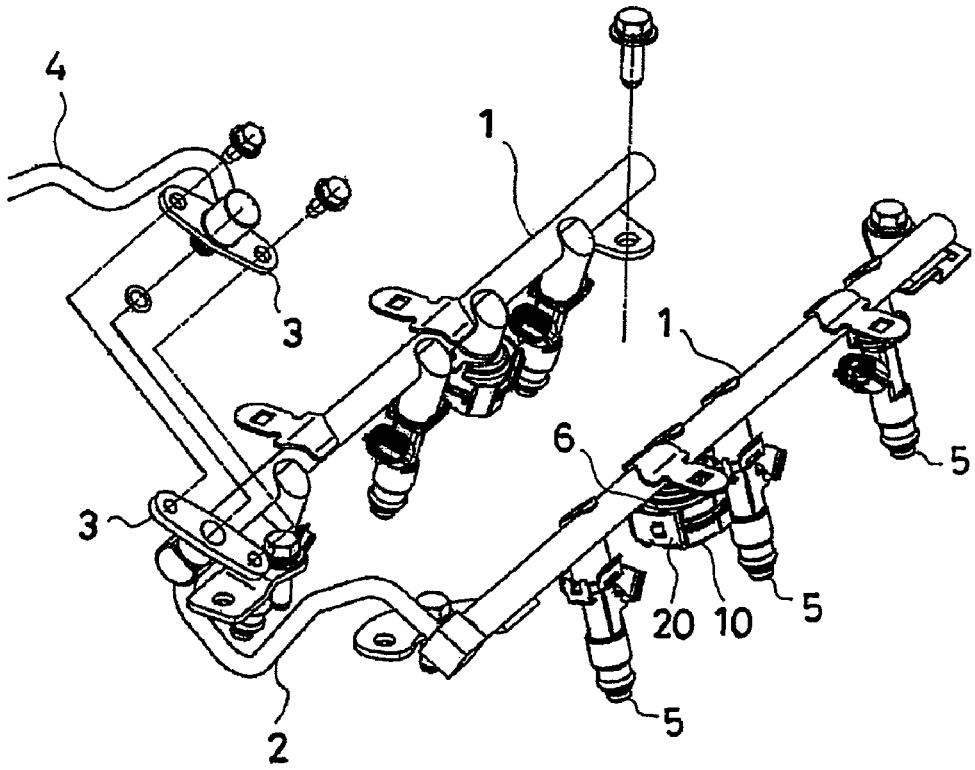
FIG. 1 is a perspective view showing the state in which fuel dampers are attached to fuel pipes.

FIG. 1 shows fuel pipes of an internal combustion engine in an embodiment of the present invention. The fuel pipes are employed in a V-type six-cylinder engine. The fuel pipes (fuel gallery) 1 are disposed at respective banks and communicate with each other through a fuel tube 2 and are connected to a fuel tube 4 from a fuel pump (not shown) through connectors 3.

The base ends of each of three sets of fuel injection valves 5 are attached to a respective fuel pipe 1, as is a fuel damper 10. An assembly of the fuel pipes 1, the fuel injection valves 5, and the fuel dampers 10 is mounted on the engine, and the distal ends of the fuel injection valves 5 are attached to the intake manifolds of the engine.

Figure 2:
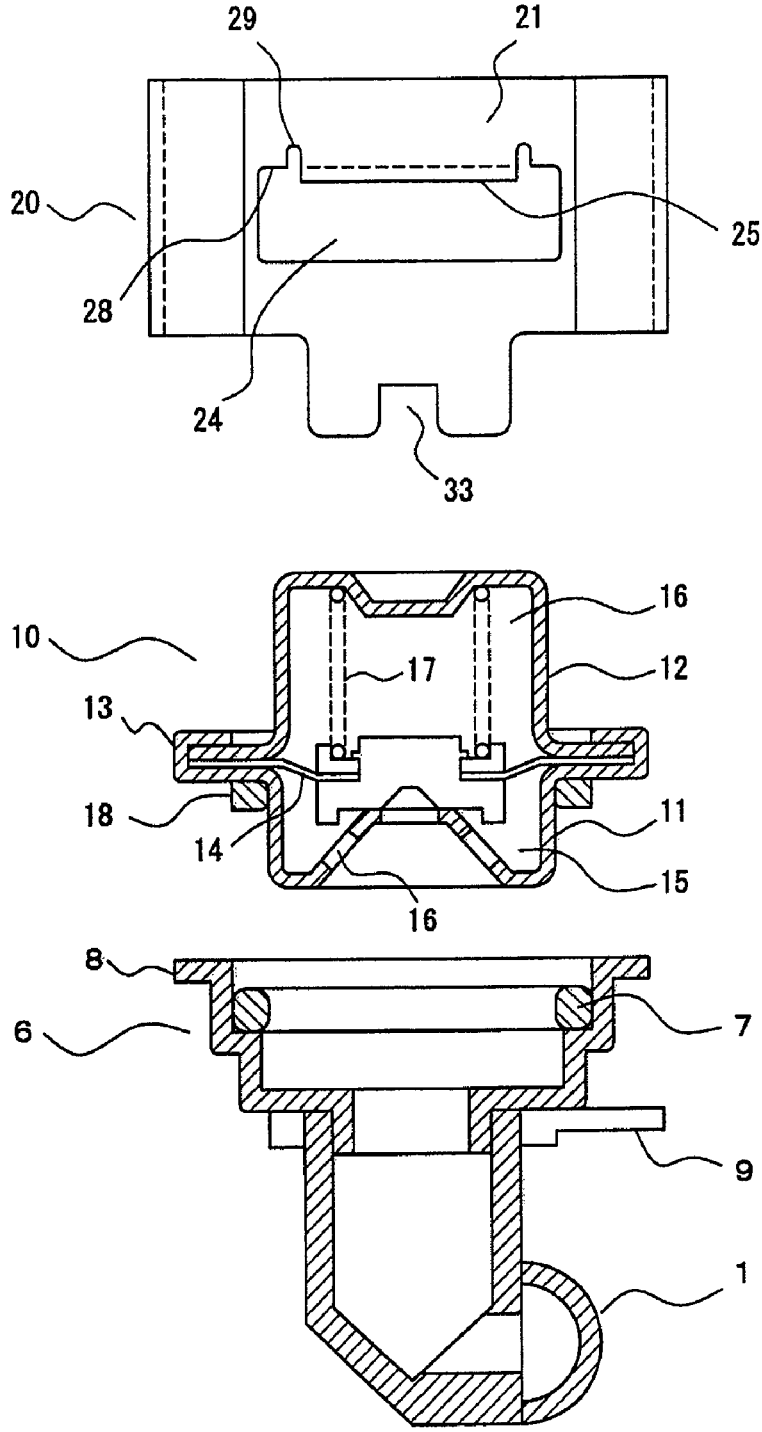
FIG. 2 is an exploded view showing an attachment structure for attaching the fuel damper to the fuel pipe.
Figure 3:
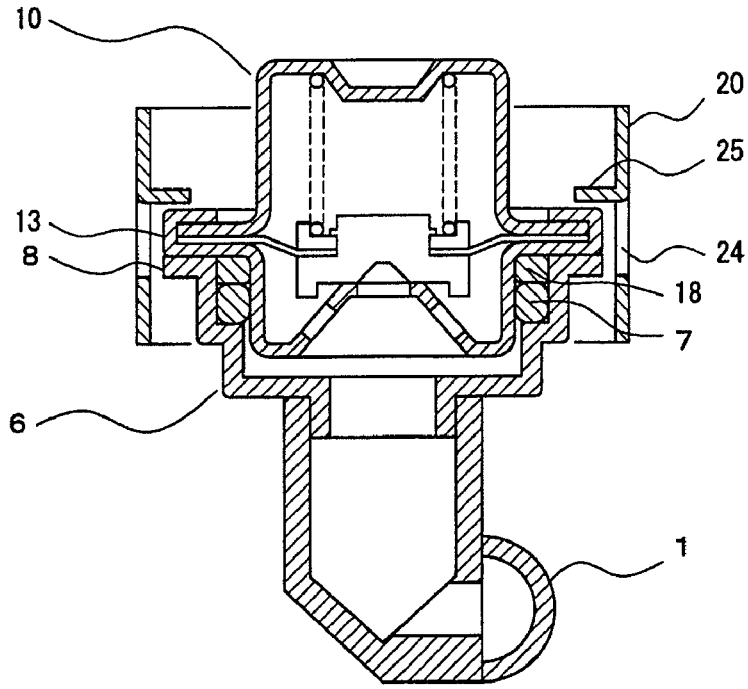
FIG. 3 is an assembly view showing an attachment structure for attaching the fuel damper to the fuel pipe, before a winding and tightening operation is performed.
Figure 4:
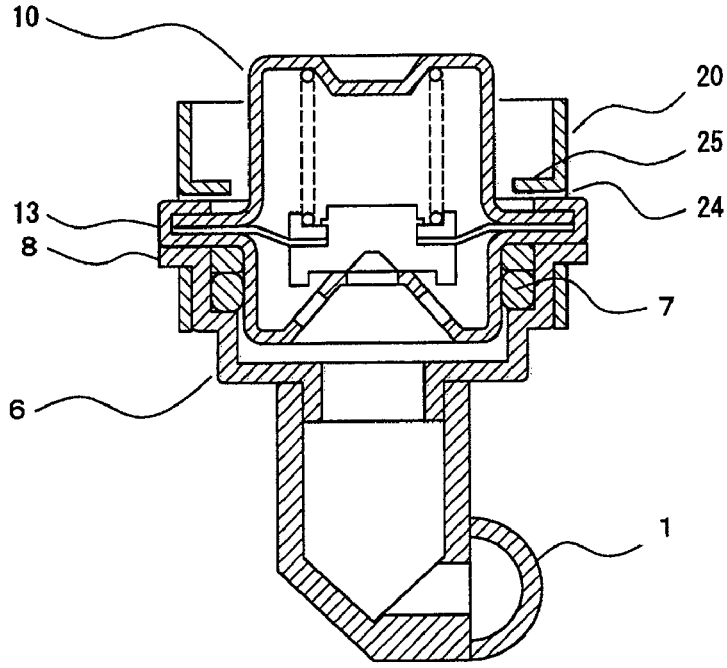
FIG. 4 an assembly view showing an attachment structure for attaching the fuel damper to the fuel pipe, after the winding and tightening operation is performed.

FIGS. 2 to 4 show an attachment structure for attaching the fuel damper to the fuel pipe, wherein FIG. 2 is an exploded view, FIG. 3 is an assembly view before a winding and tightening operation is performed, and FIG. 4 is an assembly view after the winding and tightening operation is performed. FIG. 1 shows the state when the fuel pipes are mounted on the engine, whereas FIGS. 2 to 4 show the state when the fuel dampers are attached to the fuel pipes, and thus the view of FIG. 1 is upside down with respect to those of FIGS. 2 to 4.

Referring to FIG. 2, a cup portion 6 is exposed to an inside of the fuel pipe 1 so as to open in communication with the fuel pipe 1. Although the cup portion 6 opens downward in the state that the fuel pipe 1 is mounted on the engine, the fuel damper 10 is attached to the cup portion 6 in the state that it opens upward.

An O ring 7 is attached around the inner periphery of the cup portion 6. Further, a collar portion 8 is disposed around the outer periphery of the opening end of the cup portion 6. The fuel damper 10 has an upper case 11, a lower case 12 (a case located on an upper side when it is mounted on the engine is called the upper case, and a case located on a lower side when it is mounted on the engine is called the lower case), and a collar portion 13 around the outer periphery of an intermediate portion of the fuel damper 10 which acts as a joint portion of the upper case 11 and the lower case 12. A fuel chamber 15 on the upper case 11 side and an air chamber 16 on the lower case 12 side are separated by a diaphragm 14, a peripheral edge portion of which is clamped in the joint portion. A fuel introduction port 16 to the fuel chamber 15 is formed in the upper case 11. A spring 17 is accommodated in the air chamber 16 of the lower case 12 to urge the diaphragm 14 to the fuel chamber 15 side.

When the pressure of the fuel introduced into the fuel chamber 15 is increased, the fuel damper 10 operates to suppress the variation of fuel pressure in such a manner that the diaphragm 14 is displaced to the air chamber 16 side, and increasing the volume of the fuel chamber 15.

The upper case 11, which is the head portion of the fuel damper 10, is engaged in the cup portion 6 on the fuel pipe 1 side so that the collar portion 8 around the outer periphery of the opening end of the cup portion 6 is joined to the collar portion 13 around the outer periphery of the intermediate portion of the fuel damper 10 as shown in FIG. 3. A resin backup ring 18 is attached to the fuel damper 10 and abutted against the O ring 7.

A fuel damper fixing clip (clip main body) 20 is used to fix the collar portion 8 on the cup portion 6 side to the collar portion 13 on the fuel damper 10 side in this state. FIG. 3 shows the state that the clip 20 is set, and FIG. 4 shows the state that the collar portions 8, 13 are fixed by the clip 20.

It is sufficient for the clip 20 to cause the O ring 7 to function to prevent the fuel damper 10 from falling off from the cup portion 6. Accordingly, it is sufficient for the clip 20 to regulate the amount of movement of the fuel damper 10 in an axial direction, and it is not necessary for the clip 20 to cause the fuel damper 10 not to move at all. Therefore, even if the fuel damper 10 rotates, no problem occurs in the performance thereof. However, to prevent the unnecessary rotation of the fuel damper 10, the rotation thereof is regulated by a cutout 33 disposed on the main body of the clip 20 and a projection 9 disposed on the cup portion 6 (refer to FIG. 2, in which they are dislocated from each other 90°).

Figure 5:
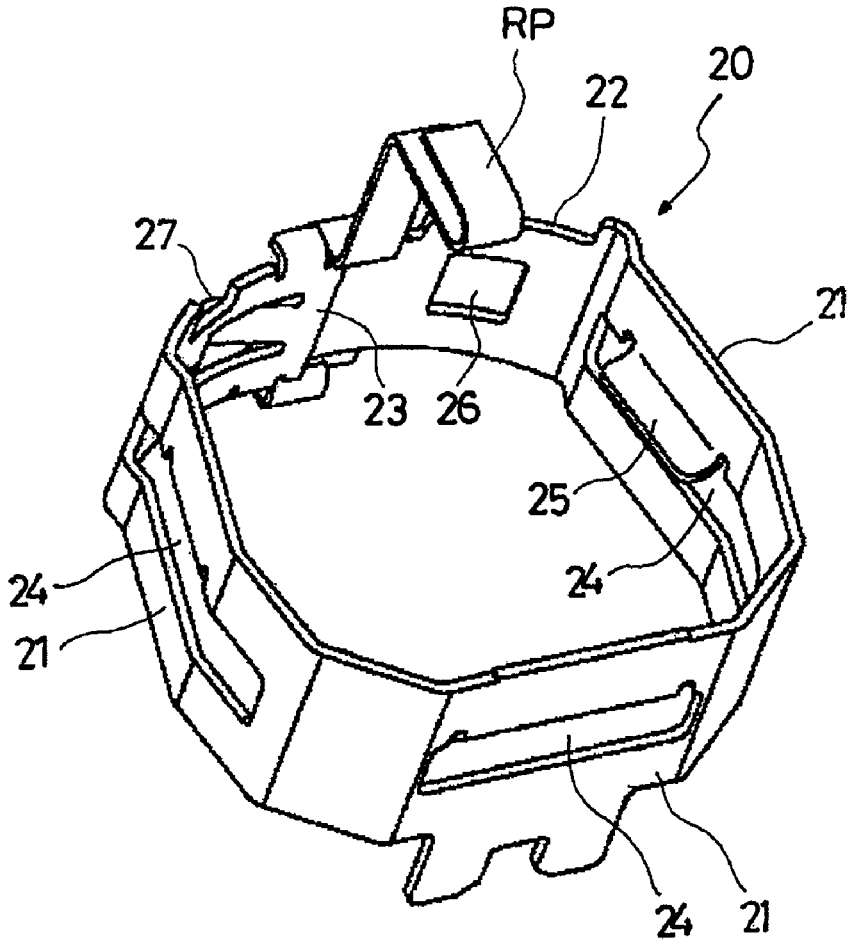
FIG. 5 is a perspective view of a clip.
Figure 6A:
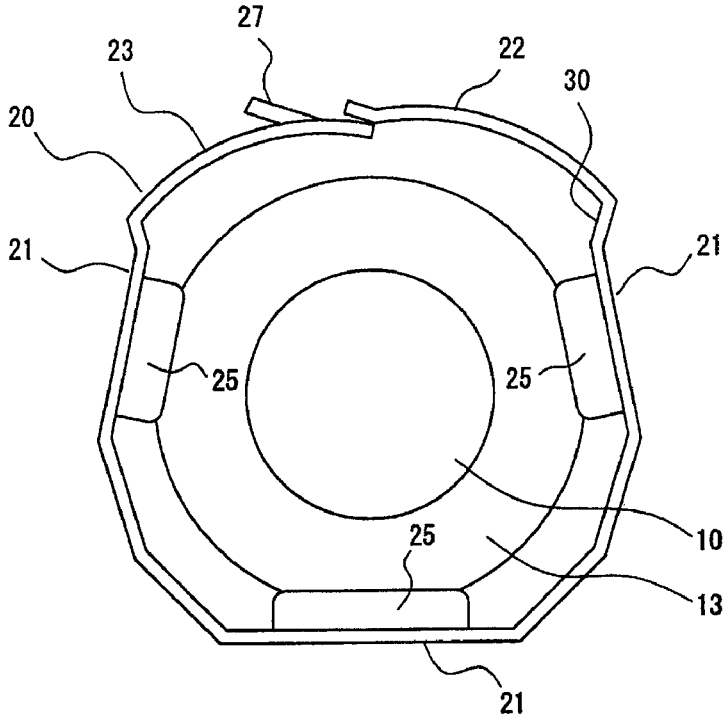
FIGS. 6A and 6B respectively show a schematic plan view and a schematic lateral sectional view of the clip in a diameter-enlarged state (open state) before it is subjected to the winding and tightening operation.
Figure 6B:
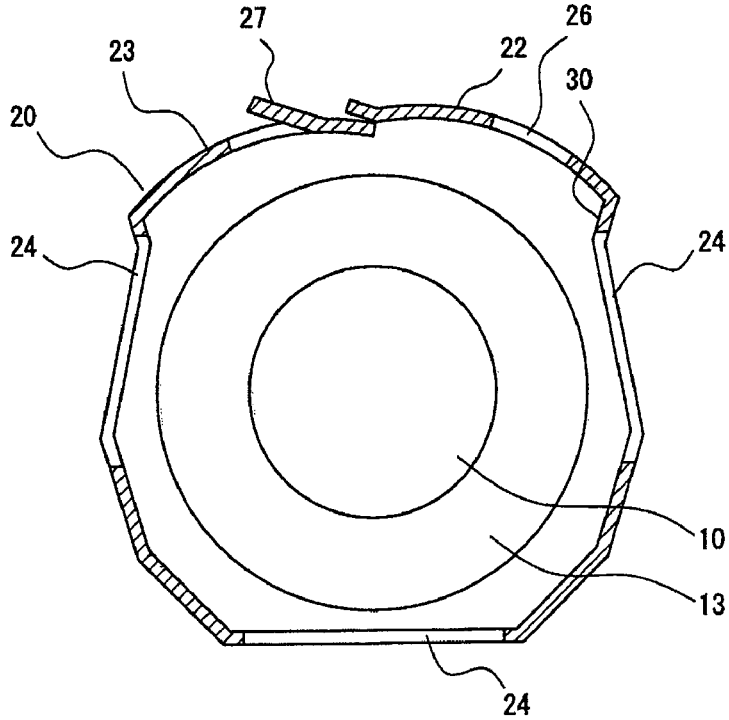
Figure 7A:
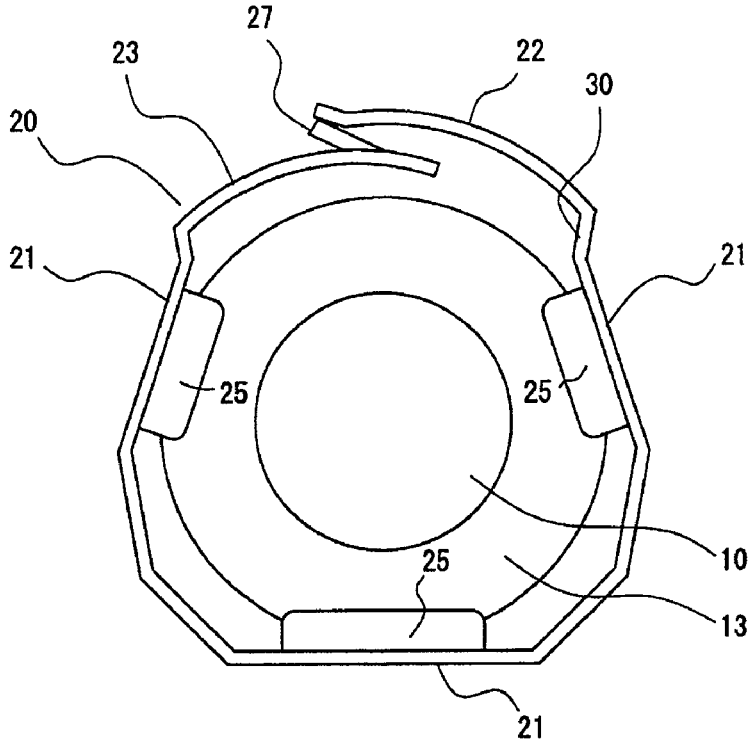
FIGS. 7A and 7B respectively show a schematic plan view and a schematic lateral sectional view of the clip while it is being subjected to the winding and tightening operation.
Figure 7B:
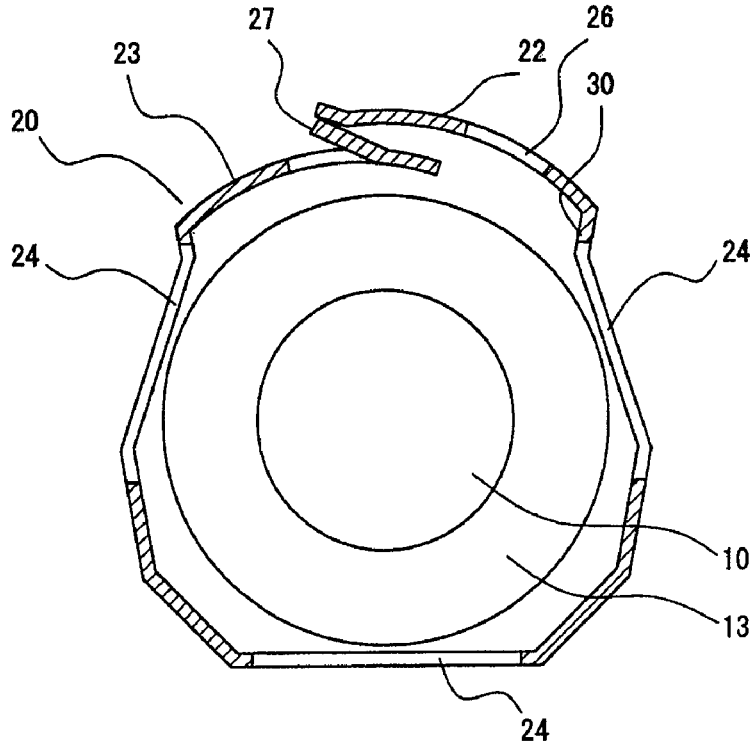
Figure 8A:
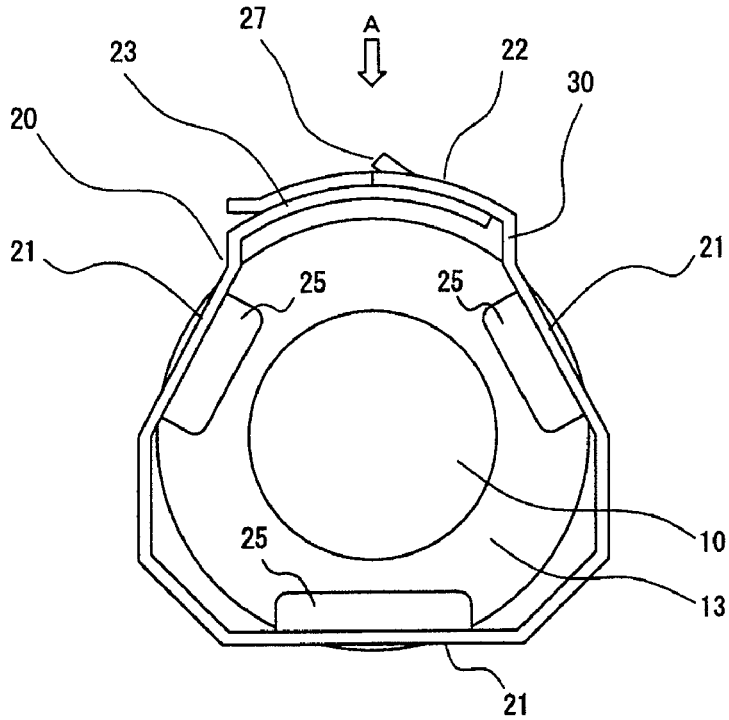
FIGS. 8A and 8B respectively show a schematic plan view and a schematic lateral sectional view of the clip in a diameter-reduced state (closed state) after it is subjected to the winding and tightening operation.
Figure 8B:
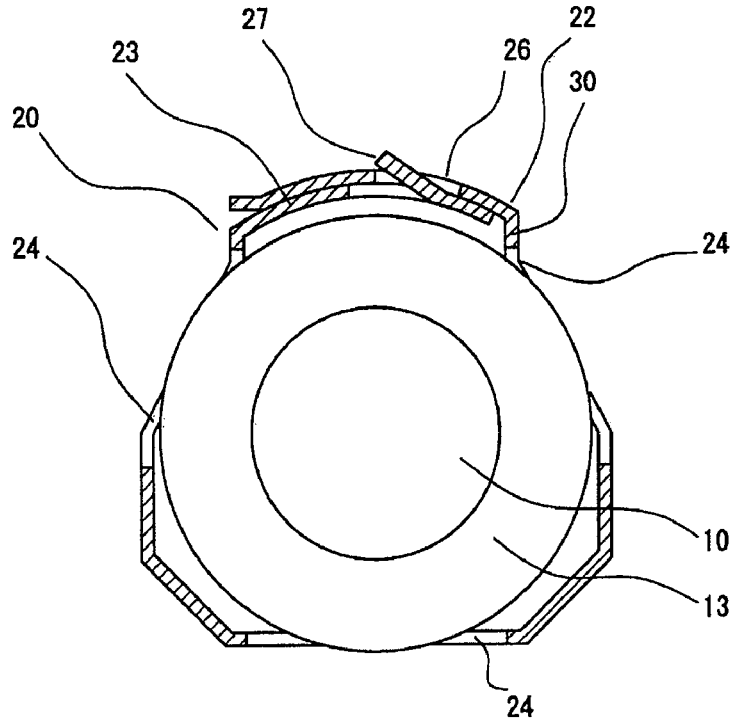
Figure 9:
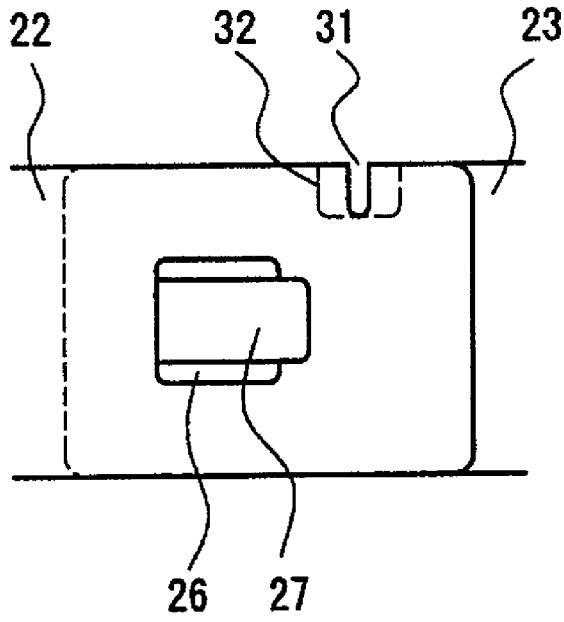
FIG. 9 is a fragmentary view taken in the direction of arrow A in FIG. 8A.

A structure of the fuel damper fixing clip 20 will be explained below in detail. FIG. 5 is a perspective view of the clip. FIGS. 6A and 6B respectively are a schematic plan view and a schematic lateral sectional view of the clip in a diameter-enlarged state (open state) before it is subjected to a winding and tightening operation. FIGS. 7A and 7B respectively are a schematic plan view and a schematic lateral sectional view of the clip while it is being subjected to the winding and tightening operation. FIGS. 8A and 8B respectively are a schematic plan view and a schematic lateral sectional view of the clip in a diameter-reduced state (closed state) after it is subjected to the winding and tightening operation. The clip in any of the views is observed from a bottom surface side (from a lower side in the state that it is mounted on the engine). FIG. 9 is a fragmentary view of FIG. 8 when the clip is observed from arrow A.

The main body of the clip 20 is formed of a sheet member which is bent and formed in a generally square cylindrical shape so as to have a plurality of (at least three) flat portions 21. With this configuration, the main body of the clip 20 covers the outer peripheries of the cup portion 6 and the fuel damper 10, and can be deformed in a winding and tightening direction, and the surfaces thereof at both the ends (arc-shaped overlapping surfaces 22, 23) are overlapped on an inside and an outside.

Slits 24 are formed in the three flat portions 21 of the main body of the square cylindrical clip 20 so that the collar portions 8, 13 of the cup portion 6 and the fuel damper 10 may enter into the slits 24 and be locked in the diameter-reduced state of the clip 20 in which it is wound and tightened. Accordingly, the slits 24 are disposed at three positions in a peripheral direction.

The abutment sides of the slits 24 against which the collar portion 13 of the fuel damper 10 is abutted have bent surfaces 25 bent inward, and the collar portion 13 of the fuel damper 10 is abutted against the slits 24 at the bent surfaces 25. A receiving hole 26 is formed in one of the arc-shaped overlapping surfaces 22 and 23 of the main body of the clip 20 (here, the outside overlapping surface 22).

A claw portion 27 is disposed on the other overlapping surface (here, the inside overlapping surface 23) so as to obliquely project in a direction opposite to the winding and tightening direction on the overlapping surface 22 side. The claw portion 27 enters into the receiving hole 26 in the diameter-reduced state of the clip 20 in which it is wound and tightened and locks (prevents) the clip 20 from returning in a direction opposite to the winding and tightening direction in the entered state.

Further, the main body of the clip 20 has a spring property, is arranged to shift to the diameter-reduced state (state in which the fuel damper 10 is fixed) by the elastically restoring force thereof, and is held in the diameter-enlarged state by attaching a lock pin RP before the fuel damper 10 is fixed (refer to FIG. 5). Therefore, when the lock pin RP is removed, the main body of the clip 20 is shifted to the diameter-reduced state by the elastically restoring force thereof. Note that the lock pin RP locks the main body of the clip 20 in the diameter-enlarged state in such a manner that it is engaged with a groove on the outside overlapping surface 22 side and with a groove on the inside overlapping surface 23 side, and when the lock pin RP is removed by depressing a handle outward, it can release the main body of the clip 20 from a locked state.

Accordingly, the fuel damper 10 is engaged in the cup portion 6 on the fuel pipe 1 side, and the collar portion 8 of the cup portion 6 is joined to the collar portion 13 of the fuel damper 10. In this state, the outer peripheries of the fuel damper 10 and the cup portion 6 are covered with the main body of the square cylindrical clip 20, to which the lock pin RP is attached so that the main body is placed in the diameter-enlarged state (the state of FIGS. 3, 6A and 6B).

The bent surfaces 25 of the slits 24 ride on the end surface of the lower case 12 of the fuel damper 10, thereby positioning is performed in an axial direction. When the lock pin RP is removed from this state (diameter-enlarged state of FIG. 6), the diameter of the main body of the clip 20 is reduced by the restoring force thereof, and the main body of the clip 20 is placed in the diameter-reduced state of FIG. 8 through the process of FIG. 7, whereby the cup portion 6 and the fuel damper 10 are wound and tightened.

The collar portions 8, 13 of the cup portion 6 and the fuel damper 10 enter into the slits 24 of the flat portions 21 and regulate the movement of the collar portions 8, 13 in the axial direction to thereby fix both the collar portions 8, 13. Further, since the collar portions 8, 13 are held at the three positions in the peripheral direction, they can be stably held.

Further, in the diameter-reduced state of FIG. 8, the claw portion 27 of the inside overlapping surface 23 enters into the receiving hole 26 of the outside overlapping surface 22. Thus, when the inside overlapping surface 23 tends to move in a diameter-enlarged direction, the movement thereof is prevented by the claw portion 27 which is caught by the edge of the receiving hole 26. Accordingly, the wound and tightened state is not released.

Therefore, the collar portions 8, 13 are wound and tightened around the entire peripheries thereof and held by the slits 24 so that they can be securely fixed. Further, since the claw portion 27 enters into the receiving hole 26 in the diameter-reduced state in which the clip 20 is wound and tightened and locks the return of the clip 20, the clip 20 can be securely prevented from being falling off.

Further, the outside overlapping surface 22 is lifted by the claw portion 27 of the inside overlapping surface 23 while the clip 20 is being wound and tightened as shown in FIG. 7. Thus, since the outside overlapping surface 23 is lifted once and then fallen, the force in the winding and tightening direction can be dispersed, so that a brake can be applied to a closing force. This prevents, for example, the fuel damper 10 being damaged due to a closing force being abruptly applied. Accordingly, the collar portions 8, 13 can be smoothly fixed.

Further, since the abutment sides of the slits 24 against which the collar portion 13 of the fuel damper 10 is abutted have the bent surfaces 25 bent inward and the collar portion 13 of the fuel damper 10 is abutted against the slits 24 through the bent surfaces 25, the following advantages can be obtained.

Although a fuel injection valve can be inserted after a clip is inserted thereinto, this method cannot be applied to the fuel damper. Accordingly, when the clip 20 cannot be fixed before it is wound and tightened, workability is deteriorated (it must be positioned so that it can be fixed at a correct position). Thus, the workability can be improved by positioning the clip 20 on the bent surfaces 25.

Further, since the collar portions 8, 13 are received on the flat surfaces (bent surfaces 25), they can be prevented from being damaged even if a large assembly force is applied. Note that although plating (coating) is applied to the collar portion 13 of the fuel damper 10 and the collar portion 8 of the cup portion 6 which are received by the flat surfaces (bent surfaces 25), respectively, the plating of the collar portion 13 of the fuel damper 10 is more liable to be exfoliated because it is subjected to bending processing more often. Thus, there is also an advantage in that exfoliation of the plating can be prevented by receiving the collar portion 13 of the fuel damper 10 on the bent surfaces 25.

Further, the attachment structure will be explained in detail. The bent surfaces 25 are located in the central portions of the slits 24 in the lengthwise direction thereof, and the portion 28, in which the bent surfaces are not formed, faces the collar portion 13 of the fuel damper 10 at a position retracted from the bent surfaces 25 (refer to FIG. 2). With this arrangement, the portion 28, in which the bent surfaces are not formed, acts as a preliminary surface and can receive the collar portion 13 of the fuel damper 10 in the event that the bent surfaces 25 are bent by an abnormal pressure. Thus, a more safe structure can be obtained.

Further, a groove 29 is formed between the portion in which the bent surfaces 25 are formed and the portion 28 in which the bent surfaces are not formed. The groove 29 extends to a position further retracted from the portion 28 in which the bent surfaces are not formed (refer to FIG. 2). Stress concentration can be prevented by the groove 29.

Further, a flat portion 30 as a stopper is disposed at the root portion of the outside overlapping surface so as to face the projecting end of the inside overlapping surface 23 (refer to FIGS. 8A and 8B). With this arrangement, even if the projecting end of the inside overlapping surface 23 overruns when the clip 20 is wound and tightened, the projecting end is abutted against the flat portion 30 as the stopper so that a stopper function can be obtained. Accordingly, damage of the inside overlapping surface 23 due to the overrun can be prevented.

Further, a position confirmation cutout 31 is disposed in the outside overlapping surface 22, and a reference range setting cutout 32 is disposed in the inside overlapping surface 23 (refer to FIG. 9). They are used to perform alignment by confirming that the outside cutout 31 is positioned in the inside cutout 32 in the diameter-reduced state. That is, when the cutout 31 is observed from the outside, if the inside overlapping surface 23 cannot be observed from the cutout 31, it is determined that assembly is normally performed. Therefore, the inside cutout 32 is set to a size within a normal range (allowable width). With this arrangement, quality of assembly can be simply checked.

While the invention has been disclosed with reference to certain preferred embodiments, numerous modifications, alterations, and changes to the described embodiments are possible without departing from the sphere and scope of the invention, as defined in the appended claims and their equivalents thereof. Accordingly, it is intended that the invention not be limited to the described embodiments, but that it have the full scope defined by the language of the following claims.

What is claimed is:

1. A fuel damper fixing clip for fixing both a collar portion around the outer periphery of an open end of a cup portion and a collar portion around the outer periphery of an intermediate portion of a diaphragm type fuel damper in a state such that a head portion of the fuel damper is engaged in the cup portion, the cup portion being in communication with a fuel pipe for supplying fuel to an internal combustion engine, and the collar portion of the cup portion being joined to the collar portion of the fuel damper, the fuel damper fixing clip comprising:

a clip main body formed from a sheet member having a plurality of flat portions, and formed in a generally square cylindrical shape, the clip main body surrounds portions of the outer peripheries of the cup portion and the fuel damper and deforms in a tightening direction, the clip main body including two ends overlapped on an outside and an inside surface thereof;

slits disposed in the plurality of flat portions of the clip main body, the collar portions of the cup portion and the fuel damper being disposed therein and locked in a diameter-reduced state of the clip main body in which the clip main body is tightened;

a receiving hole formed in one of the ends of the clip main body; and a claw portion disposed on the other end of the clip main body obliquely projecting in a direction opposite to the tightening direction, the claw portion being disposed in the receiving hole in the diameter-reduced state in which the clip main body is tightened, and locking the clip main body in the diameter-reduced state in which the collar portions are fixed.

2. The fuel damper fixing clip according to claim 1, wherein bent surfaces are bent inward adjacent the slits, and the collar portion of the fuel damper is abutted against the bent surfaces.

3. The fuel damper fixing clip according to claim 2, wherein the bent surfaces are located in central portions of the slits in a lengthwise direction thereof, and a portion of each slit, in which the bent surfaces are not formed, faces the collar portion of the fuel damper at a position retracted from the bent surfaces.

4. The fuel damper fixing clip according to claim 3, wherein a groove is formed between the portion in which the bent surfaces are formed and the portion in which the bent surfaces are not formed, the groove extending to a position further retracted from the portion in which the bent surfaces are not formed.

5. The fuel damper fixing clip according to claim 1, wherein the clip main body is held in a diameter-enlarged state by attaching a lock pin, and shifts to a diameter-reduced state by a restoring force thereof by removing the lock pin.

6. The fuel damper fixing clip according to claim 1, wherein the slits are disposed at three positions in a peripheral direction.

7. The fuel damper fixing clip according to claim 1, wherein a flat portion as a stopper is disposed at a root portion of the outside overlapped surface of one end of the clip main body so as to face the projecting end of the inside overlapped surface of the other end of the clip main body.

8. The fuel damper fixing clip according to claim 1, wherein the overlapped surfaces are formed in an arc shape.

9. The fuel damper fixing clip according to according to claim 1, wherein a position confirmation cutout is formed in the outside overlapped surface and a reference range setting cutout is formed in the inside overlapped surface to confirm that the outside cutout is positioned in the inside cutout in the diameter-reduced state.

10. A method of fixing both a collar portion around the outer periphery of an open end of a cup portion and a collar portion around the outer periphery of an intermediate portion of a diaphragm type fuel damper in a state such that a head portion of the fuel damper is engaged in the cup portion and the collar portion of the cup portion is joined to the collar portion of the fuel damper, the cup portion being in communication with a fuel pipe for supplying fuel to an internal combustion engine, the method comprising:

providing a fuel damper fixing clip having a clip main body formed from a sheet member having a plurality of flat portions and formed in a generally square cylindrical shape, slits disposed in the plurality of flat portions of the clip main body, a receiving hole formed in one end of the clip main body, and a claw portion disposed on another end of the clip main body obliquely projecting in a direction opposite to a tightening direction;

surrounding portions of the outer peripheries of the cup portion and the fuel damper with the clip main body;

disposing the collar portions of the cup portion and the fuel damper in the slits;

overlapping the two ends of the clip main body on an outside and an inside surface thereof;

deforming the clip main body in a tightening direction in a diameter-reduced state;

disposing the claw portion in the receiving hole in the diameter-reduced state in which the clip main body is tightened; and locking the clip main body in the diameter-reduced state in which the collar portions are fixed.

11. The method according to claim 10, further comprising:

abutting the collar portion of the fuel damper against bent surfaces that are bent inward adjacent the slits.

12. The method according to claim 10, further comprising:

attaching a locking pin and holding the clip main body in a diameter-enlarged state; and removing the locking pin and shifting to the diameter-reduced state by a restoring force of the clip main body.

13. The method according to according to claim 10, further comprising:

positioning a position confirmation cutout formed in the outside overlapped surface in a reference range setting cutout formed in the inside overlapped surface, in the diameter-reduced state.

* * * * *